US009312061B2

(12) United States Patent
Takagi et al.

(10) Patent No.: US 9,312,061 B2
(45) Date of Patent: Apr. 12, 2016

(54) PULSE TRANSFORMER

(71) Applicant: TDK Corporation, Tokyo (JP)

(72) Inventors: Nobuo Takagi, Tokyo (JP); Setu Tsuchida, Tokyo (JP); Tasuku Mikogami, Tokyo (JP); Tomonao Suto, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/492,669

(22) Filed: Sep. 22, 2014

(65) Prior Publication Data

US 2015/0084731 A1 Mar. 26, 2015

(30) Foreign Application Priority Data

Sep. 25, 2013 (JP) ..... 2013-197934

(51) Int. Cl.

| | |
|---|---|
| ***H01F 27/24*** | (2006.01) |
| ***H01F 17/06*** | (2006.01) |
| ***H01F 27/26*** | (2006.01) |
| ***H01F 19/08*** | (2006.01) |

(52) U.S. Cl.

CPC ..... *H01F 27/263* (2013.01); *H01F 19/08* (2013.01); *H01F 2019/085* (2013.01)

(58) Field of Classification Search

CPC ... H01F 27/263; H01F 27/2823; H01F 19/08; H01F 2019/085; H01F 17/045

USPC ..... 336/212, 83, 170, 178

See application file for complete search history.

(56) References Cited

U.S. PATENT DOCUMENTS

| | | | | |
|---|---|---|---|---|
| 5,818,226 | A * | 10/1998 | Aizawa | G01R 33/028 324/258 |
| 6,348,850 | B1 * | 2/2002 | Kimura | H01F 17/045 336/200 |
| 2005/0052267 | A1 * | 3/2005 | Singu | H01F 27/292 336/83 |
| 2010/0109827 | A1 * | 5/2010 | Asou | H01F 17/045 336/192 |
| 2012/0133469 | A1 * | 5/2012 | Tomonari | H01F 27/292 336/192 |

FOREIGN PATENT DOCUMENTS

| | | |
|---|---|---|
| JP | 2009-302321 | 12/2009 |

* cited by examiner

*Primary Examiner* — Mangtin Lian

(74) *Attorney, Agent, or Firm* — Young Law Firm, P.C.

(57) ABSTRACT

Disclosed herein is a pulse transformer that includes a drum core having a winding core portion and first and second flange portions, a plate core connected to the first and second flange portions, and a plurality of wires that are wound around the winding core portion. The first and second flange portions and the plate core are ground such that an inductance of the pulse transformer is 350 μH or more when a bias current of 8 mA is applied to the wires.

23 Claims, 12 Drawing Sheets

| SAMPLE NUMBER | GRINDING STATE | | INDUCTANCE MEASUREMENT VALUE (μH) | | |
|---|---|---|---|---|---|
| | DRUM CORE | PLATE CORE | NO BIAS | WITH BIAS | (RATE OF CHANGE) |
| 1-1 | 0.2<Ra [GRINDING IS NOT PERFORMED] | 0.2<Ra [GRINDING IS NOT PERFORMED] | 228.9 | 224.1 | 2.1% |
| 1-2 | | | 224.3 | 218.3 | 2.7% |
| 2-1 | 0.1<Ra<0.2 [#600,120 sec] | 0.2<Ra [GRINDING IS NOT PERFORMED] | 310.7 | 293.6 | 5.5% |
| 2-2 | | | 340.3 | 299.8 | 11.9% |
| 3-1 | 0.1<Ra<0.2 [#600,120 sec] | 0.05<Ra<0.1 [#800,36 sec] | 443.6 | 374.2 | 15.6% |
| 3-2 | | | 471.9 | 365.8 | 22.5% |
| 4-1 | 0.01<Ra<0.05 [#800,72 sec] | 0.01<Ra<0.05 [#800,72 sec] | 589.1 | 335.6 | 43.0% |
| 4-2 | | | 538.0 | 342.3 | 36.4% |
| 5-1 | Ra<0.01 [#2000,360 sec] | Ra<0.01 [#2000,360 sec] | 979.0 | 229.1 | 76.6% |
| 5-2 | | | 741.6 | 301.2 | 59.4% |

FIG.7

| SAMPLE NUMBER | CROSS-SECTION PHOTO AND GAP LENGTH (μm) | | | | | | |
|---|---|---|---|---|---|---|---|
| | A | B | C | D | E | AVG 1 | AVG 2 |
| 1-1 | | | | | | 4.54 | 4.99 |
| | 6.75 | 2.63 | 0.00 | 2.63 | 10.69 | | |
| 1-2 | | | | | | 5.44 | |
| | 9.56 | 5.81 | 1.13 | 2.06 | 8.63 | | |
| 2-1 | | | | | | 3.93 | 3.16 |
| | 4.13 | 4.13 | 2.25 | 2.63 | 6.53 | | |
| 2-2 | | | | | | 2.40 | |
| | 4.31 | 3.19 | 1.31 | 0.00 | 3.19 | | |
| 3-1 | | | | | | 0.60 | 0.67 |
| | 1.13 | 0.00 | 0.00 | 1.13 | 0.75 | | |
| 3-2 | | | | | | 0.75 | |
| | 0.00 | 1.31 | 1.13 | 0.75 | 0.56 | | |
| 4-1 | | | | | | 0.38 | 0.30 |
| | 0.00 | 0.75 | 0.00 | 0.00 | 1.13 | | |
| 4-2 | | | | | | 0.22 | |
| | 0.00 | 0.00 | 0.00 | 0.56 | 0.56 | | |
| 5-1 | | | | | | 0.11 | 0.06 |
| | 0.00 | 0.00 | 0.56 | 0.00 | 0.00 | | |
| 5-2 | | | | | | 0.00 | |
| | 0.00 | 0.00 | 0.00 | 0.00 | 0.00 | | |

FIG.8

PULSE TRANSFORMER

BACKGROUND OF THE INVENTION

1. Field of the Invention

The present invention relates to a pulse transformer, and more particularly relates to a surface-mount pulse transformer configured by using a drum core and a plate core.

2. Description of Related Art

When a device such as a personal computer is connected to a network such as a LAN or a telephone network, it is necessary to protect the device from the entry of ESD (ElectroStatic Discharge) and high voltage via a cable. Therefore, a pulse transformer is used in a connector that constitutes a connection point between the cable and the device.

In recent years, as the pulse transformer described above, a surface-mount pulse transformer suitable for high-density mounting is frequently used. The surface-mount pulse transformer is configured by using a drum core and a plate core. The drum core is a magnetic body, and includes a winding core portion, and a pair of flange portions that are formed at both ends of the winding core portion, where the winding core portion and the pair of flange portions are formed integrally with each other. Four wires that constitute a coil are wound around the winding core portion. These wires are connected to their respective terminal electrodes formed on each bottom surface of the pair of flange portions. The plate core is a magnetic body fixed to each top surface of the pair of flange portions. The plate core and the drum core constitute a closed magnetic path therebetween. Japanese Patent Application Laid-open No. 2009-302321 discloses an example of the surface-mount pulse transformer as described above.

According to the American National Standard Institute Standards "ANSI X3.263: 1995 (TP-PMD)" incorporated into Chapter 25 of the Ethernet Alliance Standards "IEEE-802.3", a pulse transformer used for 100Base-TX is required to achieve an inductance of 350 μH or higher under a bias current of 0 mA to 8 mA. This inductance value is very large for a small-sized pulse transformer. In order to achieve this, various improvements are needed. The technique described in Japanese Patent Application Laid-open No. 2009-302321 is one of the improvements, and achieves the above standard value by using a plate core and a drum core that have undergone mirror finishing on their contact surfaces to reduce the magnetic resistance in a magnetic path.

The principles of obtaining the inductance that satisfies the above standard value by the technique in Japanese Patent Application Laid-open No. 2009-302321 are explained below with reference to FIG. 12. FIG. 12 shows the imaginary relationship between a bias current and an inductance, which is created by the inventors of the present application, and does not show the actual measurement results.

A curved line "a" in FIG. 12 shows an example of the relationship between an inductance and a bias current in a pulse transformer in which mirror finishing is not performed on the contact surfaces of a plate core and a drum core, and an adhesive is applied to the entire contact surfaces. As shown in FIG. 12, the inductance in this example is lower than 350 μH regardless of the value of the bias current. That is, the inductance does not satisfy the above standard value at all. This is because grinding is not performed on the plate core and the drum core, and therefore there is a gap created therebetween, and moreover this gap is even enlarged by the thickness of the adhesive. If there is the gap, the magnetic resistance is increased accordingly, which results in a reduction in the inductance.

A curved line "b" in FIG. 12 shows an example of the relationship between an inductance and a bias current in a pulse transformer in which mirror finishing is performed on the contact surfaces of a plate core and a drum core, and an adhesive is applied to the entire contact surfaces. Although the inductance in this example is comparatively higher than that in the example of the curved line "a", it is still lower than 350 μH regardless of the value of the bias current. This is because a gap is created between the plate core and the drum core according to the thickness of the adhesive.

In contrast to these examples, a curved line "c" in FIG. 12 shows the relationship between an inductance and a bias current in the pulse transformer in Japanese Patent Application Laid-open No. 2009-302321. In the pulse transformer in Japanese Patent Application Laid-open No. 2009-302321, a groove is provided on the contact surface of the drum core to apply the adhesive only to the interior of the groove, and moreover mirror finishing is performed on the contact surfaces of the plate core and the drum core. Therefore, the plate core and the drum core come into close contact with each other except the groove portion. This suppresses the magnetic resistance on the contact surfaces to a low level in the poise transformer in Japanese Patent Application Laid-open No. 2009-302321. As a result, the inductance that exceeds 350 μH is achieved under a bias current of 0 mA to 8 mA as shown in FIG. 12.

However, the technique in Japanese Patent Application Laid-open No. 2009-302321 has a problem that, while the pulse transformer with a size (4.5 mm×3.2 mm×2.9 mm) described in Japanese Patent Application Laid-open No. 2009-302321 can achieve the inductance that satisfies the above standard value, the pulse transformer with a smaller size (for example, 3.3 mm×3.3 mm×2.7 mm) cannot obtain a sufficient inductance particularly when the bias current is high. This problem is explained below in detail.

As shown in FIG. 12, the inductance along the curved line "c" is decreased as the bias current is increased within the range between 0 mA and 8 mA. This is because, as a result of bringing the plate core and the drum core into close contact with each other by the mirror finishing, magnetic saturation is more likely to occur in the pulse transformer in Japanese Patent Application Laid-open No. 2009-302321. As the bias current is increased, the amount of magnetic saturation becomes larger, and accordingly the inductance is reduced. Therefore, in the case of bringing the plate core and the drum core into close contact with each other to increase the inductance, it is necessary to consider this inductance reduction in designing a pulse transformer.

One of the important factors for designing such a pulse transformer is the inductance obtained when the bias current is 0 mA (hereinafter, "inductance initial value"). Assuming that the inductance initial value is sufficiently large, even when the inductance is decreased by magnetic saturation inversely proportional to the increase in bias current, this inductance can still be maintained at 350 μH or higher under the bias current of 8 mA as shown by the curved line "c" in FIG. 12.

Provided that the contact surfaces of the plate core and the drum core are under the same conditions, the inductance initial value becomes larger as the cross-sectional area of the magnetic path in the contact-surface portion becomes larger. In the pulse transformer in Japanese Patent Application Laid-open No. 2009-302321, the groove portion does not function as a magnetic path. However, the size of the pulse transformer is large originally enough to ensure a sufficiently large cross-sectional area of the magnetic path in the contact-surface portion. Therefore, as shown by the curved line "c" in FIG.

12, the inductance initial value is sufficiently large (which can maintain the inductance at 350 μH or higher under the bias current of 8 mA).

In contrast to this, in a pulse transformer with a smaller size of 3.3 mm×3.3 mm×2.7 mm, although assuming that the need for adhesion is ignored, and thus an adhesive filling groove is not provided, it is still difficult to increase the cross-sectional area of the magnetic path in the contact-surface portion to such a degree as to obtain an inductance initial value large enough to compensate for a decrease in the inductance due to magnetic saturation. A curved line "d" in FIG. 12 shows an example of the pulse transformer with the size of 3.3 mm×3.3 mm×2.7 mm. This example is a hypothetical example in which an adhesive filling groove is not provided, and the inductance is below 350 μH under the bias current of 8 mA. As described above, in the technique in Japanese Patent Application Laid-open No. 2009-302321, the pulse transformer with a smaller size cannot satisfy the standard inductance value in some cases, and is required to be improved.

SUMMARY

Therefore, one of objects of the present invention is to provide a pulse transformer that can realize an inductance of 350 μH or higher under a bias current of 0 mA to 8 mA even when the pulse transformer has a small size of approximately 3.3 mm×3.3 mm×2.7 mm.

In order to achieve the above object, a pulse transformer of the present invention comprises a drum core that includes a winding core portion, and first and second flange portions that are provided at both ends of the winding core portion, respectively; a plate core that includes a bottom surface having first and second portions, the first portion of the bottom surface facing to a top surface of the first flange portion, and the second portion of the bottom surface facing to a top surface of the second flange portion; first and second wires that are wound around the winding core portion, the first and second wires constituting a primary winding; and third and fourth wires that are wound around the winding core portion, the third and fourth wires constituting a secondary winding, the top surface of the first flange portion, the top surface of the second flange portion, the first portion, and the second portion being ground such that an inductance becomes equal to or higher than 350 μH when a bias current of 8 mA is applied to the first and second wires.

According to the present invention, a gap, created between contact surfaces by roughly grinding the surfaces intentionally (specifically in such a manner that the inductance becomes equal to or higher than 350 μH under the bias current of 8 mA), functions as a minute magnetic gap that suppresses magnetic saturation. Therefore, even when the pulse transformer has a small size of approximately 3.3 mm×3.3 mm×2.1 mm, the pulse transformer can still achieve the inductance of 350 μH or higher under the bias current of 0 mA to 8 mA.

The above poise transformer can further comprise an adhesive that is arranged between the plate core and parts of the first to fourth wires, which are wound around the winding core portion. With this configuration, as there is no need to provide such an adhesive filling groove as described in Japanese Patent Application Laid-open No. 2009-302321, it is possible to increase the aforementioned inductance initial value accordingly.

In the above pulse transformer, the top surface of the first flange portion, the top surface of the second flange portion, the first portion, and the second portion can be ground such that an average gap length between the drum, core and the plate core becomes equal to or larger than 0.60 μm and equal to or smaller than 0.75 μm, and further the top surface of the first flange portion and the top surface of the second flange portion can be ground such that surface roughness becomes equal to or greater than 0.1 and equal to or smaller than 0.2, and the first portion and the second portion can be ground such that surface roughness becomes equal to or greater than 0.05 and equal to or smaller than 0.1.

According to the present invention, a gap, created between contact surfaces by roughly grinding the surfaces intentionally (specifically in such a manner that the inductance becomes equal to or higher than 350 μH under the bias current of 8 mA), functions as a minute magnetic gap that suppresses magnetic saturation. Therefore, even when the pulse transformer has a small size of approximately 3.3 mm×3.3 mm×2.7 mm, the pulse transformer can still achieve the inductance of 350 μH or higher under the bias current of 0 mA to 8 mA.

BRIEF DESCRIPTION OF THE DRAWINGS

The above and other objects, features and advantages of this invention will become more apparent by reference to the following detailed description of the invention taken in conjunction with the accompanying drawings, wherein:

FIG. 7 shows a relationship between an inductance of the pulse transformer 1 shown in FIG. 1 and a grinding state of a top surface 4Au of a flange portion 4A, a top surface 4Bu of a flange portion 4B, a first portion 51*a* of the bottom surface 51 of the plate core 5, and a second portion 51*b* of the bottom surface 51 of the plate core 5;

FIG. 8 shows a cross-section photo and a gap length of each sample shown in FIG. 7;

FIGS. 10A and 10B show a relationship between an average gap length and an inductance in the pulse transformer shown in FIG. 1, in which FIG. 10A shows the inductance relative to each "AVG 1" shown in FIG. 8, and FIG. 10B shows the inductance relative to each "AVG 2" shown in FIG. 8;

DETAILED DESCRIPTION OF THE EMBODIMENTS

Figure 1:
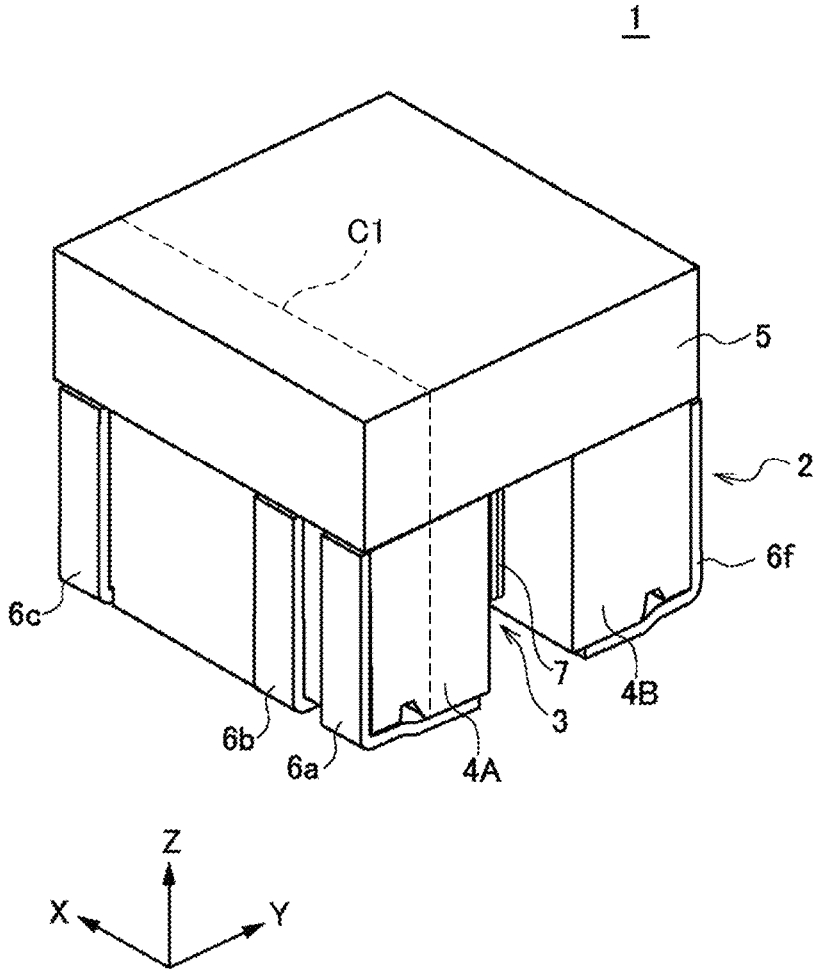
FIG. 1 is a schematic perspective view of an external configuration of a pulse transformer 1 according to a preferred embodiment of the present invention.

Preferred embodiments of the present invention will now be explained in detail with reference to the drawings.

As shown in FIGS. 1 to 5, a pulse transformer 1 according to the present embodiment includes a drum core 2, a plate core 5, six terminal fittings 6*a* to 6*f*, and a coil 7 that is constituted by four wires S1 to S4 (first to fourth fires) that are wound around the drum core 2. Although not particularly limited thereto, the size of the pulse transformer 1 in the X-direction, Y-direction, and Z-direction is 3.3 mm×3.3 mm×2.7 mm, for example.

The drum core 2 is made of a magnetic material such as Ni—Zn-based ferrite, and includes a winding core portion 3 on which the coil 7 is wound, and first and second flange portions 4A and 4B that are provided at both ends of the winding core portion 3 in the Y-direction. The plate core 5 is also made of a magnetic material such as Ni—Zn-based ferrite, and is arranged such that a first portion 51*a* (FIG. 3) of a bottom surface 51 is opposed to a top surface 4Au (FIG. 2) of the first flange portion 4A, and a second portion 51*b* (FIG. 3) of the bottom surface 51 is opposed to a top surface 4Bu (FIG. 2) of the second flange portion 4B. The first characteristic of the present invention is grinding of the contact surfaces of the drum core 2 and the plate core 5. This is explained later in detail.

The drum core 2 and the plate core 5 are fixed with an adhesive 8 (FIGS. 2 and 4) arranged between a top surface 7*u* (FIG. 2) of a part of the coil 7, which is wound around the winding core portion 3, and the bottom surface 51 (a part between the first portion 51*a* and the second portion 51*b*) of the plate core 5. The second characteristic of the present invention is the arrangement of the adhesive 8 as described above. Because the adhesive 8 is arranged as described above, it is no longer necessary to arrange the adhesive 8 on the contact surfaces of the drum core 2 and the plate core 5. Therefore, it is not necessary to provide such an adhesive filling groove as described in Japanese Patent Application Laid-open No. 2009-302321.

The terminal fittings 6*a* to 6*f* are L-shaped metallic pieces that are extended from the bottom surface of the flange portions 4A and 4B toward their outer side surface. The outer side surface of a flange portion is a surface located on the opposite side to the surface to which the winding core portion 3 is attached. It is preferable that the terminal fittings 6*a* to 6*f* are cut out from a lead frame obtained by machining one metal plate. The terminal fittings 6*a* to 6*f*, which remain in a state of the lead frame, are fixedly bonded to the drum core 2, and then are cut off from the lead frame to become independent terminals. Using the terminal fittings 6*a* to 6*f* makes it easier to form terminal electrodes as compared to the case of using baked electrodes with conductive-powder containing paste applied thereto. Therefore, this is more advantageous in terms of mass-production costs. Further, it is possible to improve the positioning accuracy of the terminal electrodes.

Three terminal fittings 6*a*, 6*b*, and 6*c* of the terminal fittings 6*a* to 6*f* are provided on the side of the flange portion 4A, and the other three terminal fittings 6*d*, 6*e*, and 6*f* are provided on the side of the flange portion 4B. The terminal fittings 6*a*, 6*b*, and 6*c* are arrayed on the flange portion 4A in the X-direction. The terminal fittings 6*d*, 6*e*, and 6*f* are arrayed on the flange portion 4B in the X-direction.

Figure 2:
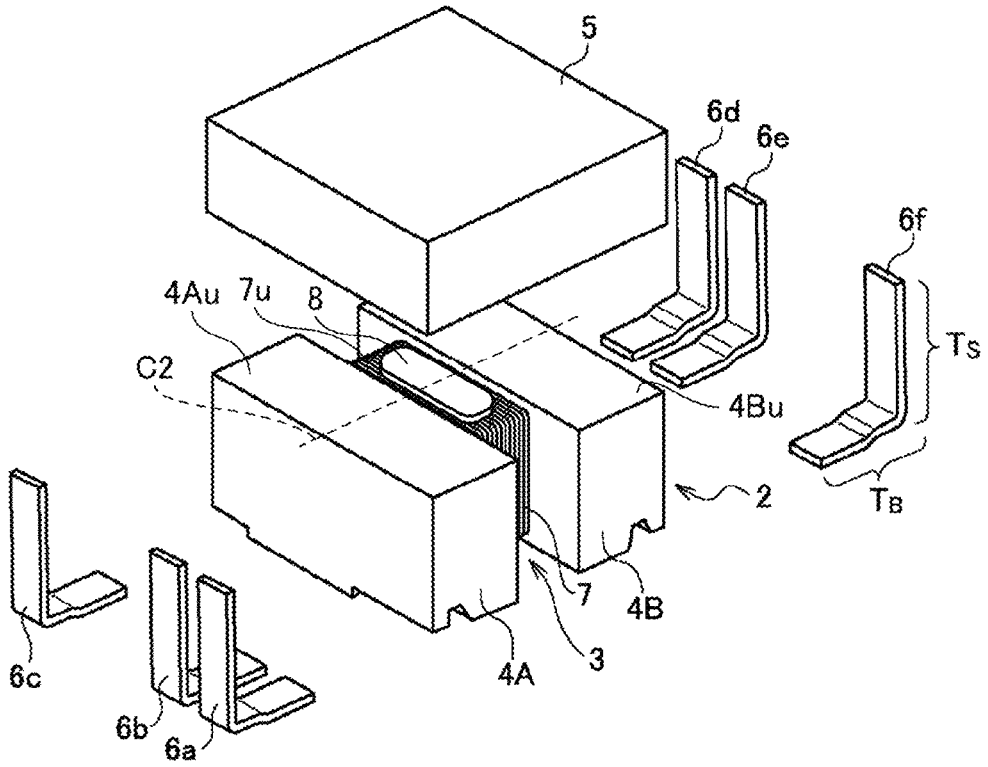
FIG. 2 is an exploded perspective view of the pulse transformer 1 shown in FIG. 1.
Figure 3:
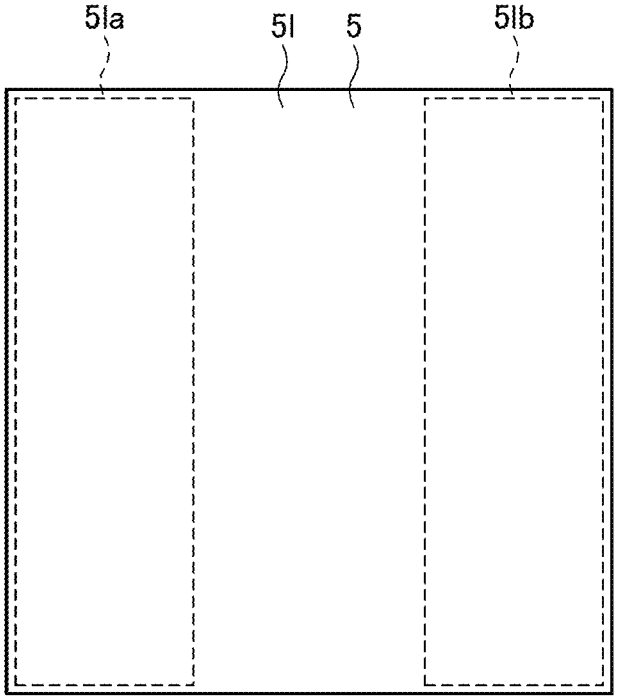
FIG. 3 is a plan view of a bottom surface 51 of a plate core 5 included in the pulse transformer 1 shown in FIG. 1.
Figure 4:
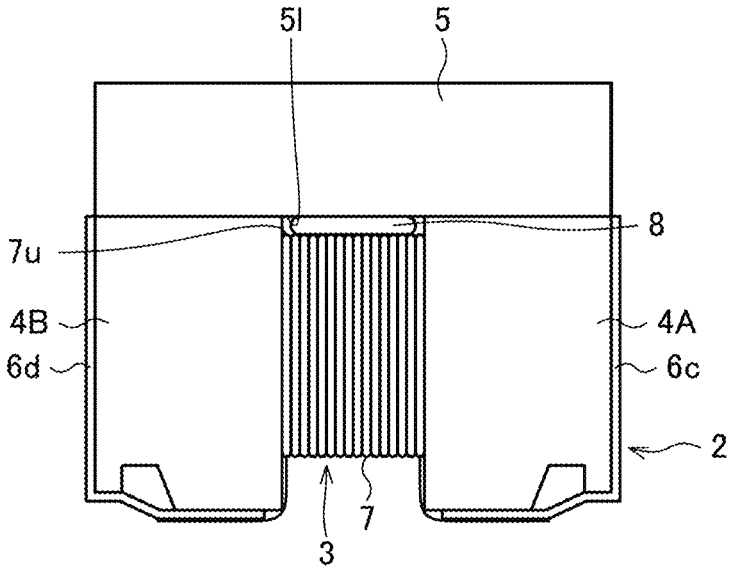
FIG. 4 is a side view of the pulse transformer 1 shown in FIG. 1 as viewed from a side of terminal fittings 6*c* and 6*d;*

Two terminal fittings 6*a* and 6*b* of the three terminal fittings 6*a*, 6*b*, and 6*c* are provided closer to one end of the flange portion 4A in the X-direction (rightward in FIG. 2). The terminal fitting 6*c* is provided closer to the other end of the flange portion 4A in the X-direction (leftward in FIG. 2). That is, the spacing between the terminal fittings 6*b* and 6*c* is wider than the spacing between the terminal fittings 6*a* and 6*b*. This ensures a dielectric strength voltage between the primary side and the secondary side. Similarly, two terminal fittings 6*d* and 6*e* of the three terminal fittings 6*d*, 6*e*, and 6*f* are provided closer to one end of the flange portion 4B in the X-direction (leftward in FIG. 2). The terminal fitting 6*f* is provided closer to the other end of the flange portion 4B in the X-direction (rightward in FIG. 2). That is, the spacing between the terminal fittings 6*e* and 6*f* is wider than the spacing between the terminal fittings 6*d* and 6*e*. This ensures a dielectric strength voltage between the primary side and the secondary side.

Figure 5:
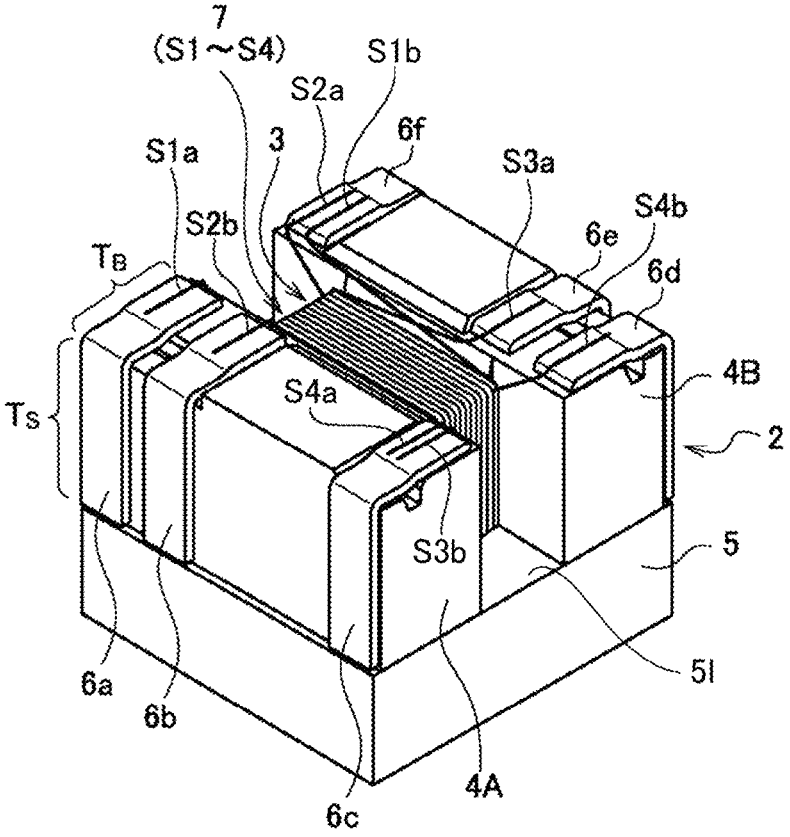
FIG. 5 is a schematic perspective view of the pulse transformer 1 shown in FIG. 1 as viewed from a mounting-surface side.

As shown in FIG. 2, each of the terminal fittings 6*a* to 6*f* having an L shape includes a bottom portion $T_B$ that comes into contact with the bottom surface of the flange portion 4A or 4B, and a side portion $T_S$ that comes into contact with the outer side surface of the flange portion 4A or 4B. As shown in FIG. 5, each end of the four wires S1 to S4 that constitute the coil 7 is thermocompression-bonded to the surface of the bottom portion $T_B$ of each of the terminal fittings 6*a* to 6*f*.

The wires S1 to S4 are all covered conductive wires, and are wound around the winding core portion 3 to have a double-layer structure. More specifically, the wires S1 and S4 are wound by bifilar winding (single-layer winding with two wires alternately arranged) to constitute a first layer, and the wires S2 and S3 are wound by bifilar winding to constitute a second layer. The number of turns of the wires S1 to S4 is equal to each other.

The winding direction of the wires S1 to S4 is different between the first layer and the second layer. That is, for example, as viewed from the side of the first flange portion 4A in the winding direction from the first flange portion 4A toward the second flange portion 4B, the wires S1 and S4 are wound in a counterclockwise direction, and in contrast, the wires S2 and S3 are wound in a clockwise direction. The reason for this is to eliminate the need for extending each wire from one end to the other end of the winding core portion 3 at the time of start and end of the winding.

One end S1*a* and the other end S1*b* of the wire S1 are connected to the terminal fittings 6*a* and 6*f*, respectively. One end S2*a* and the other end S2*b* of the wire S2 are connected to the terminal fittings 6*f* and 6*b*, respectively. One end S3*a* and the other end S3*b* of the wire S3 are connected to the terminal fittings 6*e* and 6*c*, respectively. One end S4*a* and the other end S4*b* of the wire S4 are connected to the terminal fittings 6*c* and 6*d*, respectively.

Figure 6:
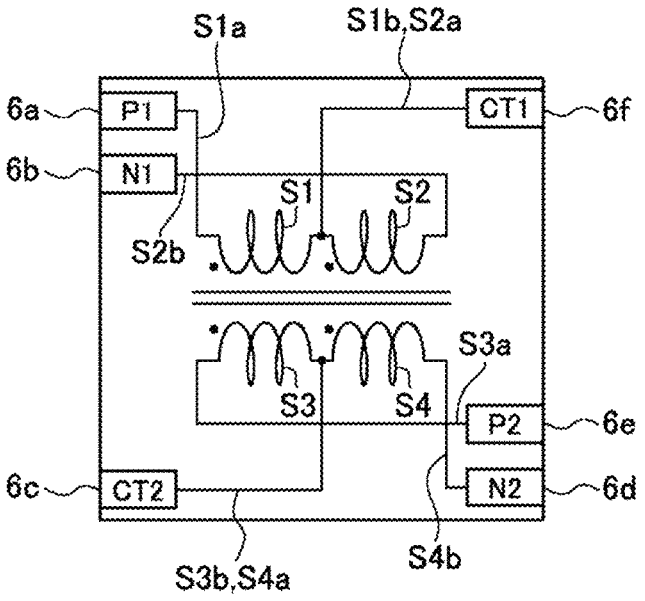
FIG. 6 is an equivalent circuit diagram, of the pulse transformer 1 shown in FIG. 1.

With the above configuration, as shown in FIG. 6, the wires S1 and S2 constitute a primary winding of the pulse transformer 1, and the wires S3 and S4 constitute a secondary winding of the pulse transformer 1. The terminal fittings 6*a* and 6*b* constitute a pair of balanced inputs, that are, a positive terminal electrode P1 and a negative terminal electrode N1 on the primary side. The terminal fittings 6*e* and 6*d* constitute a pair of balanced outputs, that are, a positive terminal electrode P2 and a negative terminal electrode N2 on the secondary side. The terminal fittings 6*f* and 6*c* constitute input side and output side center taps CT1 and CT2, respectively.

Grinding of the contact surfaces of the drum core 2 and the plate core 5 is explained in detail using an Example.

FIGS. 7 and 8 show "grinding state", "inductance measurement value", "cross-section photo", and "average gap length" of each of ten samples with five different grinding states (the sample number 1-1 to 5-1 and 1-2 to 5-2).

First, the "grinding state" is explained. The "drum core" field in FIG. 7 shows the grinding state of the top surface 4Au of the first flange portion 4A and the top surface 4Bu of the second flange portion 4B. In the following explanations, these surfaces may be collectively referred to as "drum-core-side surface". The "plate core" field in FIG. 7 shows the grinding state of the first portion 51*a* and the second portion 51*b* of the bottom surface 51 of the plate core 5. In the following explanations, these surfaces may be collectively referred to as "plate-core-side surface".

Ra shown in FIG. 7 represents surface roughness (arithmetic average roughness) defined in the Japanese Industrial Standards "JIS B 0601:1994". FIG. 7 shows the results of the surface roughness measured in a uniform manner from a center line C2 in the X-direction of the pulse transformer 1 shown in FIG. 2 toward its both ends. The number and the time shown in the square bracket in the "grinding state" field represent the type of the grindstone used and the grinding time.

As shown in FIG. 7, the samples 1-1 and 1-2 are examples in which grinding is not performed on both the drum-core-side surface and the plate-core-side surface. The measurement result of the surface roughness Ra is equal to or greater than 0.2 on both the drum-core-side surface and the plate-core-side surface. The samples 2-1 and 2-2 are examples in which, while grinding is performed on the drum-core-side surface for 120 seconds using a grindstone of #600, grinding is not performed on the plate-core-side surface. The measurement result of the surface roughness Ra is 0.1<Ra<0.2 on the drum-core-side surface, and is 0.2<Ra on the plate-core-side surface. The samples 3-1 and 3-2 are examples in which, while grinding is performed on the drum-core-side surface for 120 seconds using a grindstone of #600, grinding is performed on the plate-core-side surface for 36 seconds using a grindstone of #800. The measurement result of the surface roughness Ra is 0.1<Ra<0.2 on the drum-core-side surface, and is 0.05<Ra<0.1 on the plate-core-side surface. The samples 4-1 and 4-2 are examples in which grinding is performed on both the drum-core-side surface and the plate-core-side surface for 72 seconds using a grindstone of #800. The measurement result of the surface roughness Ra is 0.01<Ra<0.05 on both the drum-core-side surface and the plate-core-side surface. The samples 5-1 and 5-2 are examples in which grinding is performed on both the drum-core-side surface and the plate-core-side surface for 360 seconds using a grindstone of #2000. The measurement result of the surface roughness Ra is Ra<0.01 on both the drum-core-side surface and the plate-core-side surface.

Figure 9:
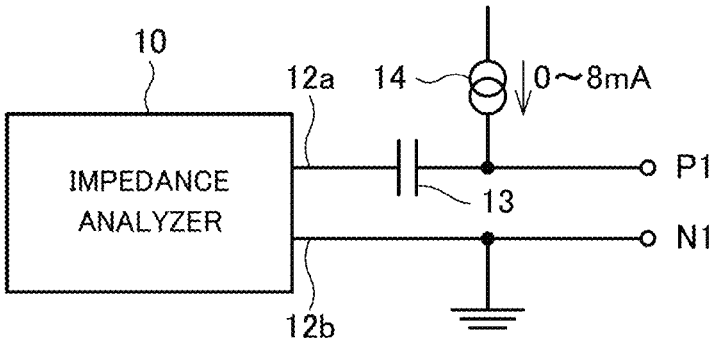
FIG. 9 shows an inductance measurement system of the pulse transformer 1 shown in FIG. 1.

The "inductance measurement value" represents the value of an inductance of a pulse transformer, which was measured by a method compliant with the American National Standard Institute Standards "ANSI X3.263". With reference to FIG. 9, a specific measurement method is explained below. An impedance analyzer 10 that includes terminals 12*a* and 12*b* was used as a measurement device. While specifically, the "4294A PRECISION Impedance Analyzer" manufactured by Agilent Technologies, Inc. was used, it is also possible to use other impedance analyzers. The positive terminal electrode P1 (FIG. 6) of the pulse transformer 1 was connected to the terminal 12*a* of the impedance analyzer 10 through a capacitor 13, and was also connected to an output end of a current source 14 that generates a bias current. The negative terminal electrode N1 (FIG. 6) of the pulse transformer 1 was connected to the terminal 12*b* of the impedance analyzer 10 and to a ground wire to which a ground potential is supplied. Measurement was performed by the impedance analyzer 10 in a state where the current source 14 generated a bias current (DC) of 0 mA or 8 mA (in a state where the bias current was applied to the wires S1 and S2) under a condition of 100 kHz and 100 mVrms.

In FIG. 7, the "No Bias" field shows the measurement result in a state where a bias current is not applied (in a state where a bias current of 0 mA is applied), and the "With Bias" field shows the measurement result in a state where a bias current of 8 mA is applied. The "rate of change" field in FIG. 7 shows the result obtained by subtracting the measurement result in the "With Bias" field from the measurement result in the "No Bias" field, and then dividing the subtracted result by the measurement result in the "No Bias" field.

Next, the "cross-section photo" in FIG. 8 is a photo of a cut cross section C1 shown in FIG. 1, which is photographed using a scanning electron microscope (SEM). In FIG. 8, the photo does not show the cut cross section C1 in its entirety, but shows only a part of the cut cross section C1, which is adjacent to the contact surfaces of the drum core 2 and the plate core 5, in such a manner as to be divided into five regions "A" to "E". The region "A" represents a region corresponding to the furthest side (the left side) of the contact surfaces of the drum core 2 and the plate core 5 in FIG. 1. In contrast, the region "E" represents a region corresponding to the nearest side (the right side) of the contact surfaces of the drum core 2 and the plate core 5 in FIG. 1. The regions "B" to "D" are arranged between the region "A" and the region "E". All the regions "A" to "E" are arranged with equal spacing.

Lastly, the "average gap length" is explained below. The numerical value for each cross-section photo shown in FIG. 8 is a measurement result of the average value (the average gap length) of the length of the gap (the gap between the drum core 2 and the plate core 5) that appears on the corresponding cross-section photo, obtained by using a length-measuring function of the SEM. The "AVG 1" field in FIG. 8 shows the average gap length of each sample, obtained from the respective average gap lengths described above. As shown in the "AVG 1" field, the average gap length of the samples 1-1, 1-2, 2-1, 2-2, 3-1, 3-2, 4-1, 4-2, 5-1, and 5-2 is 4.54 μm, 5.44 μm, 3.93 μm, 2.40 μm, 0.60 μm, 0.75 μm, 0.38 μm, 0.22 μm, 0.11 μm, and 0.00 μm, respectively.

The "AVG 2" field in FIG. 8 shows the average gap length in each grinding state, which is obtained from the numerical values in the "AVG 1" field. The average gap length is shown in the "AVG 2" field as follows. The average gap length in the grinding state corresponding to the samples 1-1 and 1-2 is 4.99 μm. The average gap length in the grinding state corresponding to the samples 2-1 and 2-2 is 3.16 μm. The average gap length in the grinding state corresponding to the samples 3-1 and 3-2 is 0.67 μm. The average gap length in the grinding state corresponding to the samples 4-1 and 4-2 is 0.30 μm. The average gap length in the grinding state corresponding to the samples 5-1 and 5-2 is 0.06 μm. As understood from these numerical values, as the surface roughness Ra is made smaller by grinding, the average gap length of the contact surfaces becomes smaller.

As understood from the "inductance measurement value" shown in FIG. 7, when a bias current is not applied, the inductance of each sample becomes higher as the surface roughness Ra is made smaller by grinding. In the samples 3-1 to 5-2, the inductance exceeds 350 μH, and therefore satisfies the standard value at least under the bias current of 0 mA.

On the other hand, when a bias current of 8 mA is applied, while the inductance exceeds 350 μH in the samples 3-1 and 3-2, the inductance is below 350 μH in other samples. Taking into account the fact that the average gap length of the samples 4-1, 4-2, 5-1, and 5-2 is smaller than that of the samples 3-1 and 3-2, it is considered that when grinding is further carried on after the grinding state of the samples 3-1 and 3-2, magnetic saturation occurs, thereby causing a reduction in the inductance.

Figure 10A:
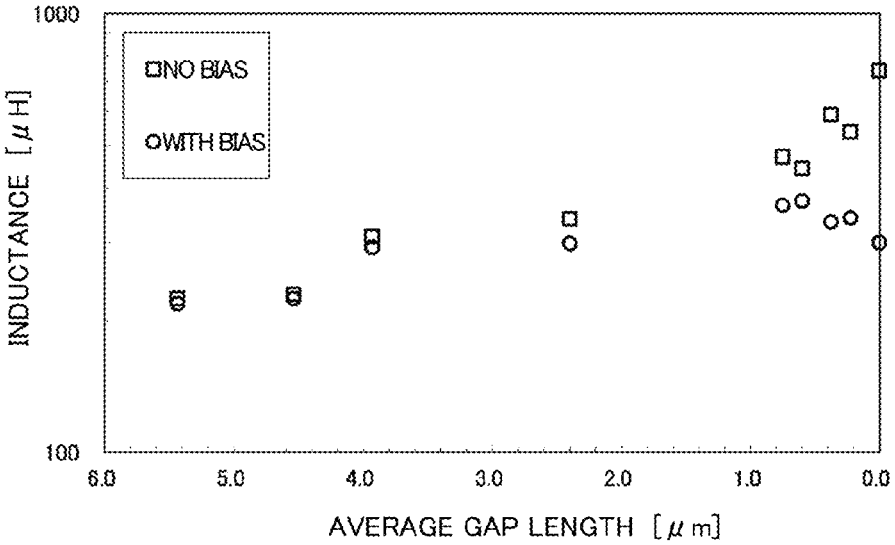
Figure 10B:
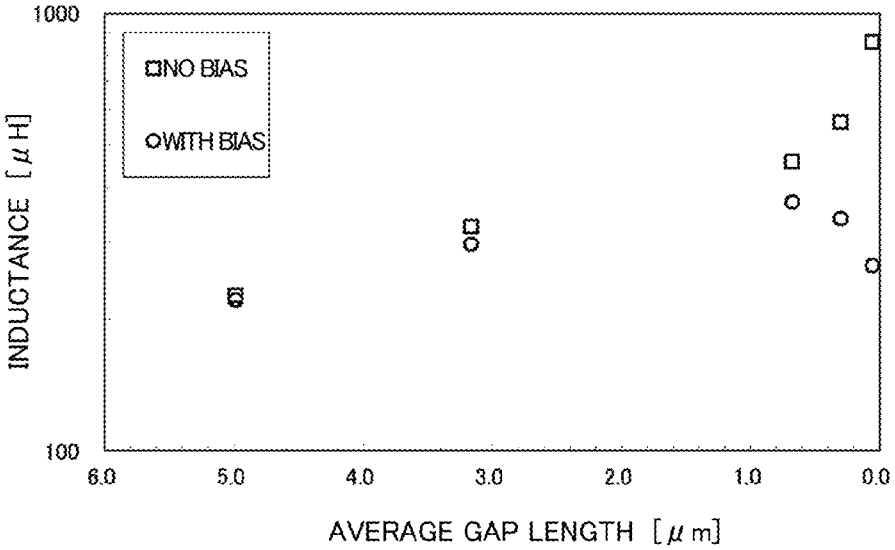

The above descriptions become more apparent by referring to the relationship between the average gap length and the inductance shown in FIGS. 10A and 10B. As shown in FIGS. 10A and 10B, when a bias current is not applied, as the average gap length becomes larger, the measurement value of the inductance becomes larger. That is, magnetic saturation has not occurred. In contrast, when a bias current of 8 mA is applied, there is a peak of the inductance near the average gap length of 0.6 μm, and the measurement value of the inductance is decreased from the peak even if the average gap length becomes smaller or lager than 0.6 μm. As a result of this, it is considered that when a bias current of 8 mA is applied, and then the average gap length is below approximately 0.6 μm, a reduction in the inductance is caused due to magnetic saturation.

It is understood from the above results that in order to achieve an inductance of 350 μH or higher under a bias current of 8 mA, it is necessary to perform grinding such that the average gap length becomes at least equal to or larger than 0.60 μm (the sample 3-1 case) and equal to or smaller than 0.75 μm (the sample 3-2 case). Conversely, in the pulse transformer 1 according to the present embodiment, by performing grinding such that the average gap length becomes equal to or larger than 0.60 μm and equal to or smaller than 0.75 μm, it is possible to achieve an inductance of 350 μH or higher under a bias current of 8 mA. As described above regarding the samples 3-1 and 3-2, the above average gap length can be obtained by performing grinding on the drum-core-side surface so as to obtain 0.1<Ra<0.2 and by performing grinding on the plate-core-side surface so as to obtain 0.05<Ra<0.1.

As explained above, in the pulse transformer 1 according to the present embodiment, the top surface 4Au of the first flange portion 4A, the top surface 4Bu of the second flange portion 4B, the first portion 51*a* of the bottom surface 51 of the plate core 5, and the second portion 51*b* of the bottom surface 51 of the plate core 5 are roughly ground intentionally (specifically in such a manner that the inductance becomes equal to or higher than 350 μH under the bias current of 8 mA). Therefore, as compared to the case of performing mirror finishing (normally, Ra<0.01), a larger gap is created between the contact surfaces of the drum core 2 and the plate core 5. Because this gap functions as a minute magnetic gap that suppresses magnetic saturation, it is possible to achieve an inductance of 350 μH or higher under a bias current of 0 mA to 8 mA in the pulse transformer 1 with a small size of 3.3 mm×3.3 mm×2.7 mm.

Figure 12:
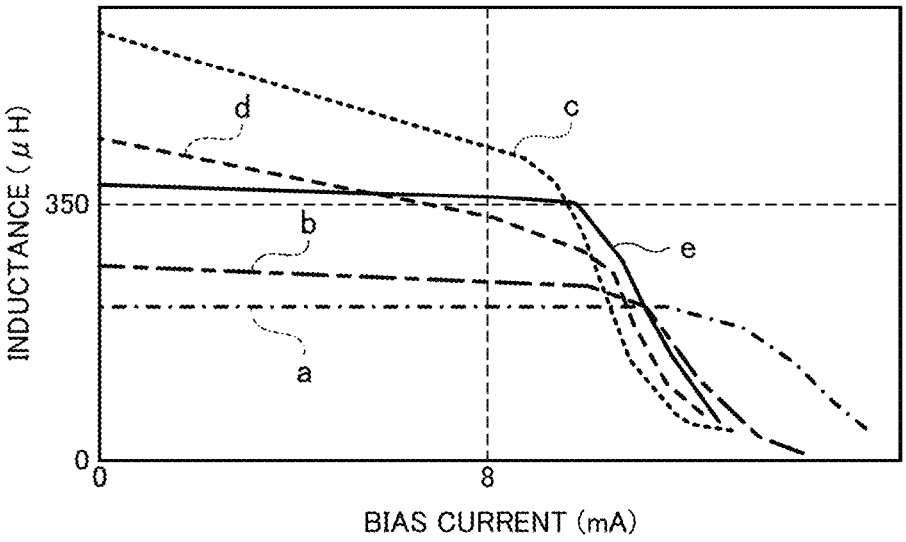
FIG. 12 shows a relationship between a bias current and an inductance, in which "a" to "d" show comparative examples, and "e" shows a working example.

A curved line "e" in FIG. 12 shows an example of the relationship between an inductance and a bias current in the pulse transformer 1, in which the top surface 4Au of the first flange portion 4A, the top surface 4Bu of the second flange portion 4B, the first portion 51*a* of the bottom surface 51 of the plate core 5, and the second portion 51*b* of the bottom surface 51 of the plate core 5 are ground such that the inductance becomes equal to or higher than 350 μH under the bias current of 8 mA. As understood from the comparison of the curved line "e" with the curved line "c", although in the pulse transformer 1, the inductance initial value is smaller than that in the example of the curved line "c", the rate of decrease in the inductance relative to the increase in the bias current is lower than that in the example of the curved line "c". As a result, the inductance of 350 μH or higher is achieved even under the bias current of 8 mA. This is because a relatively large gap, created between the contact surfaces by roughly grinding them intentionally, suppresses magnetic saturation.

In the pulse transformer 1 according to the present embodiment, an adhesive is arranged between the top surface 7*u* of the coil 7 and the bottom surface 51 of the plate core 5. Therefore, there is no need to provide such an adhesive filling groove as described in Japanese Patent Application Laid-open No. 2009-302321. Accordingly, as compared to the case of providing an adhesive filling groove, it is possible to increase the inductance initial value described above.

It is apparent that the present invention is not limited to the above embodiments, but may be modified and changed without departing from the scope and spirit of the invention.

Figure 11:
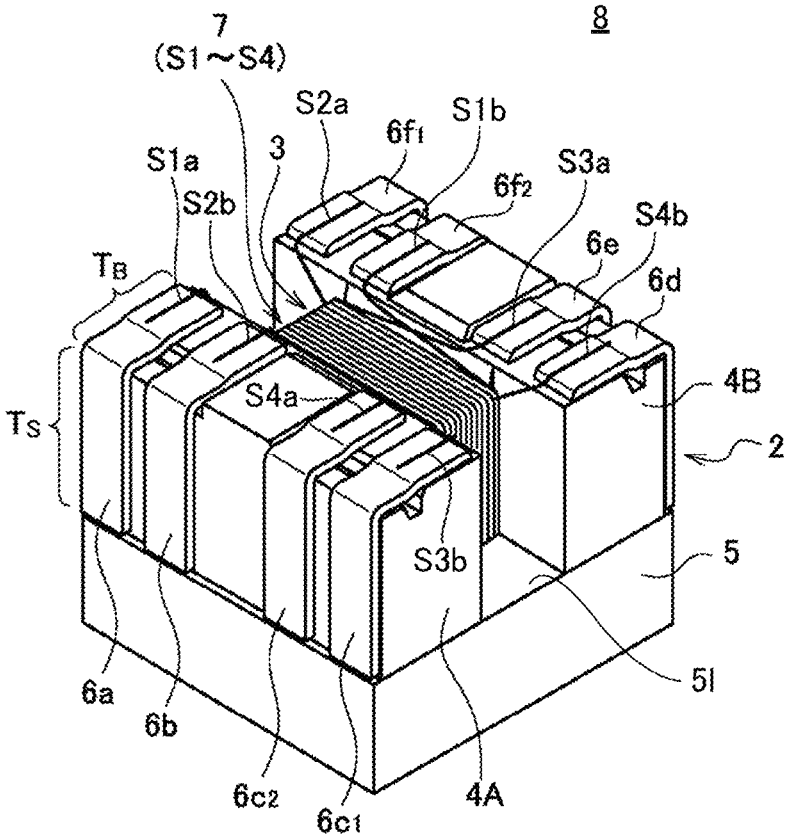
FIG. 11 is a schematic perspective view of a pulse transformer 8 according to a first modification of the preferred embodiment of the present invention, as viewed from the mounting-surface side.

For example, the present invention can be preferably applied to a different type of pulse transformer in which four terminal fittings are attached to each of the first flange 4A and the second flange 4B as shown in a pulse transformer 8 in FIG. 11. A configuration of the pulse transformer 8 is explained below.

As shown in FIG. 11, the pulse transformer 8 has a configuration in which the terminal fitting 6*c* in the pulse transformer 1 is split into two terminal fittings 6*c*1 and 6*c*2, and the terminal fitting 6*f* in the pulse transformer 1 is split into two terminal fittings 6*f*1 and 6*f*2. In this case, the other end S3*b* of the wire S3 is connected to the terminal fitting 6*c*1, the one end S4*a* of the wire S4 is connected to the terminal fitting 6*c*2, the one end S2*a* of the wire S2 is connected to the terminal fitting 6*f*1, and the other end S1*b* of the wire S1 is connected to the terminal fitting 6*f*2.

The terminal fittings 6*c*1 and 6*c*2 are short-circuited with each other through a land pattern (not shown) on a printed circuit board on which the pulse transformer 8 is mounted. Similarly, the terminal fittings 6*f*1 and 6*f*2 are short-circuited with each other through another land pattern (not shown) on the printed circuit board on which the pulse transformer 8 is mounted. Therefore, it is supposed to be possible for the pulse transformer 8 to realize the same functions as those of the pulse transformer 1 explained in the above embodiment.

The pulse transformer 8 as described above can also achieve an inductance of 350 μH or higher under a bias current of 8 mA in the same way as the pulse transformer 1 by adjusting the degree of grinding the top surface 4Au of the first flange portion 4A, the top surface 4Bu of the second flange portion 4B, the first portion 51*a* of the bottom surface 51 of the plate core 5, and the second portion 51*b* of the bottom surface 51 of the plate core 5.

In the pulse transformer 8, an adhesive (not shown) may be arranged between the top surface 7*u* of the coil 7 and the bottom surface 51 of the plate core 5 as with the pulse transformer 1. In doing so, there is no need to provide such an adhesive filling groove as described in Japanese Patent Application Laid-open No. 2009-302321. Accordingly, it is supposed to be possible to increase the inductance initial value described above.

In the above embodiments, the present invention has been explained by using an example of the pulse transformer in which a terminal electrode is configured by a terminal fitting. However, the present invention is also preferably applicable to a pulse transformer that uses a terminal electrode formed by other methods, such as a baked electrode or a screen-printed electrode.

What is claimed is:

1. A pulse transformer comprising:

a drum core that includes a winding core portion, and first and second flange portions that are provided at both ends of the winding core portion, respectively;

a plate core that includes a bottom surface having first and second portions, the first portion of the bottom surface facing to a top surface of the first flange portion, and the second portion of the bottom surface facing to a top surface of the second flange portion;

first and second wires that are wound around the winding core portion, the first and second wires constituting a primary winding; and third and fourth wires that are wound around the winding core portion, the third and fourth wires constituting a secondary winding, the top surface of the first flange portion, the top surface of the second flange portion, the first portion, and the second portion being ground such that an inductance becomes equal to or higher than 350 μH when a bias current of 8 mA is applied to the first and second wires.

2. The pulse transformer as claimed in claim 1, further comprising an adhesive that is arranged between the plate core and parts of the first to fourth wires, which are wound around the winding core portion.

3. The pulse transformer as claimed in claim 1, wherein the top surface of the first flange portion, the top surface of the second flange portion, the first portion, and the second portion are ground such that an average gap length between the drum core and the plate core becomes equal to or larger than 0.60 μm and equal to or smaller than 0.75 μm.

4. The pulse transformer as claimed in claim 3, wherein the top surface of the first flange portion and the top surface of the second flange portion are ground such that surface roughness becomes equal to or greater than 0.1 and equal to or smaller than 0.2, and the first portion and the second portion are ground such that surface roughness becomes equal to or greater than 0.05 and equal to or smaller than 0.1.

5. The pulse transformer as claimed in claim 1, wherein the winding core extends to a first direction, the top surfaces of the first and second flange portions extend in parallel to a second direction that is substantially perpendicular to the first direction, and each of a first length of the pulse transformer in the first direction and a second length of the pulse transformer in the second direction is equal to or less than 3.3 mm.

6. The pulse transformer as claimed in claim 5, wherein the first and second lengths are substantially equal to each other.

7. The pulse transformer as claimed in claim 6, wherein a third length of the pulse transformer in a third direction that is substantially perpendicular to each of the first and second directions is smaller than the first and second lengths.

8. A pulse transformer comprising:

a drum core that includes a winding core portion having first and second ends, a first flange portion connected to the first end of the winding core portion, and a second flange portion connected to the second end of the winding core portion;

a plate core that includes a first portion contacting to the first flange portion without an intervention of an adhesive such that an average gap length therebetween is 0.60 μm or more and 0.75 μm or less and a second portion contacting to the second flange portion without an intervention of an adhesive such that an average gap length therebetween is 0.60 μm or more and 0.75 μm or less; and a plurality of wires that are wound around the winding core portion.

9. The pulse transformer as claimed in claim 8, further comprising an adhesive fixing the plate core to the drum core such that the adhesive and the wires are positioned between the plate core and the winding core portion of the drum core.

10. The pulse transformer as claimed in claim 8, wherein the first flange portion has a top surface contacting to the first portion of the plate core, the second flange portion has a top surface contacting to the second portion of the plate core, and a surface roughness of the top surfaces of the first and second flange portions is 0.1 or more and 0.2 or less.

11. The pulse transformer as claimed in claim 8, wherein a surface roughness of the first and second portions is 0.05 or more and 0.1 or less.

12. The pulse transformer as claimed in claim 8, wherein an inductance of the pulse transformer is 350 μH or more.

13. The pulse transformer as claimed in claim 8, wherein an inductance of the pulse transformer is 350 μH or more when a bias current of 8 mA is applied to the wires.

14. The pulse transformer as claimed in claim 8, wherein the first flange portion has a top surface contacting to the first portion of the plate core, the second flange portion has a top surface contacting to the second portion of the plate core, the winding core extends to a first direction, the top surfaces of the first and second flange portions extend in parallel to a second direction that is substantially perpendicular to the first direction, and each of a first length of the pulse transformer in the first direction and a second length of the pulse transformer in the second direction is equal to or less than 3.3 mm.

15. The pulse transformer as claimed in claim 14, wherein the first and second lengths are substantially equal to each other.

16. The pulse transformer as claimed in claim 15, wherein a third length of the pulse transformer in a third direction that is substantially perpendicular to each of the first and second directions is smaller than the first and second lengths.

17. A pulse transformer comprising:

a drum core that includes a winding core portion having first and second ends, a first flange portion connected to the first end of the winding core portion, and a second flange portion connected to the second end of the winding core portion;

a plate core that includes a first portion contacting to a top surface of the first flange portion without an intervention of an adhesive and a second portion contacting to a top surface of the second flange portion without an intervention of an adhesive; and a plurality of wires that are wound around the winding core portion, wherein a surface roughness of the top surfaces of the first and second flange portions is 0.1 or more and 0.2 or less, and a surface roughness of the first and second portions is 0.05 or more and 0.1 or less.

18. The pulse transformer as claimed in claim 17, further comprising an adhesive fixing the plate core to the drum core such that the adhesive and the wires are positioned between the plate core and the winding core portion of the drum core.

19. The pulse transformer as claimed in claim 17, wherein an inductance of the pulse transformer is 350 μH or more.

20. The pulse transformer as claimed in claim 17, wherein an inductance of the pulse transformer is 350 μH or more when a bias current of 8 mA is applied to the wires.

21. The pulse transformer as claimed in claim 17, wherein the winding core extends to a first direction, the top surfaces of the first and second flange portions extend in parallel to a second direction that is substantially perpendicular to the first direction, and each of a first length of the pulse transformer in the first direction and a second length of the pulse transformer in the second direction is equal to or less than 3.3 mm.

22. The pulse transformer as claimed in claim 21, wherein the first and second lengths are substantially equal to each other.

23. The pulse transformer as claimed in claim 22, wherein a third length of the pulse transformer in a third direction that is substantially perpendicular to each of the first and second directions is smaller than the first and second lengths.

* * * * *